US008113998B2

(12) United States Patent
Daniel

(10) Patent No.: US 8,113,998 B2
(45) Date of Patent: Feb. 14, 2012

(54) DEVICE AND METHOD FOR TRAINING ABDOMINAL MUSCLES

(76) Inventor: Nir Daniel, Tel-Aviv (IL)

( * ) Notice: Subject to any disclaimer, the term of this patent is extended or adjusted under 35 U.S.C. 154(b) by 0 days.

(21) Appl. No.: 12/864,092

(22) PCT Filed: Jan. 22, 2009

(86) PCT No.: PCT/IL2009/000092

§ 371 (c)(1),
(2), (4) Date: Jul. 22, 2010

(87) PCT Pub. No.: WO2009/093245

PCT Pub. Date: Jul. 30, 2009

(65) Prior Publication Data

US 2010/0298105 A1 Nov. 25, 2010

Related U.S. Application Data

(60) Provisional application No. 61/006,588, filed on Jan. 23, 2008, provisional application No. 61/136,360, filed on Aug. 29, 2008.

(51) Int. Cl.
*A63B 26/00* (2006.01)
*A63B 21/04* (2006.01)

(52) U.S. Cl. ..... 482/140; 482/130

(58) Field of Classification Search ..... 482/140, 482/111–113, 129–131, 83, 85, 90
See application file for complete search history.

(56) References Cited

U.S. PATENT DOCUMENTS

| | | | | |
|---|---|---|---|---|
| 3,022,072 | A * | 2/1962 | Zinnow | 482/90 |
| 5,399,134 | A | 3/1995 | Abboudi et al. | |
| 6,022,303 | A * | 2/2000 | Abdo | 482/140 |
| 6,113,522 | A * | 9/2000 | Fontenot et al. | 482/111 |
| 6,248,047 | B1 | 6/2001 | Abdo | |
| 6,312,366 | B1 * | 11/2001 | Prusick | 482/130 |
| 6,422,980 | B1 | 7/2002 | Simonson | |
| 2002/0111257 | A1 * | 8/2002 | Hur | 482/140 |
| 2007/0015636 | A1 | 1/2007 | Molter et al. | |
| 2007/0032356 | A1 | 2/2007 | Rief | |
| 2007/0287618 | A1 * | 12/2007 | Verheem | 482/140 |
| 2009/0048082 | A1 * | 2/2009 | Abbott | 482/140 |

OTHER PUBLICATIONS

International Search Report of Application No. PCT/IL09/00092 mailed on May 18, 2009.

* cited by examiner

*Primary Examiner* — Fenn Mathew

(57) ABSTRACT

A device and method are disclosed for training the abdominal muscles of a user in an upright position. The device and method are configured to lead the upper torso of the user while bending along a preferred path, so that the backbone is bent in a proper manner causing a proper training of the abdominal muscles.

13 Claims, 10 Drawing Sheets

DEVICE AND METHOD FOR TRAINING ABDOMINAL MUSCLES

CROSS-REFERENCE TO RELATED APPLICATIONS

This application is a National Phase Application of PCT International Application No. PCT/IL2009/000092, International Filing Date Jan. 22, 2009, entitled Device and Method for Training Abdominal Muscles, published on Jul. 30, 2009 as International Patent Application Publication Number WO 2009/093245 claiming priority of U.S. Patent Application 61/006,588, filed Jan. 23, 2008 and U.S. Patent Application 61/136,360 filed Aug. 29, 2008, both which are incorporated herein by reference in their entirety.

BACKGROUND OF THE INVENTION

Training of the abdominal set of muscles involves right activation of these muscles, while gradually bending the spinal backbone, preferably against controlled counter-force to allow controlled loading of these muscles. Only few devices for training the abdominal muscles are known which correctly lead the body of the user along a correct path of bending of the upper portion of the body. Most of these few devices are planned to use the user's own weight as a counter-force. None of these few devices is meant to be operated from a straight up position or a sitting position. Thus, when using most of the known devices, from a lay-down position the user has to overcome a substantially strong counter-power such as the user's own body weight. Yet for many users this is a limitation which may not be overcome, thus—such users are practically prevented from using the few known devices. Yet, training the abdominal muscles from a stand-up position without a counter-force against the bending body is almost useless, as the force required to be applied when the body bends down is substantially zero or even negative. If a training device known in the art is used, it will not lead the user's body to perform a correct bent trajectory as is required for the spinal backbone.

SUMMARY OF THE INVENTION

A device and method according to the present invention are disclosed, in which a user may train his abdominal muscles properly, from a straight-up position thus the user is not forced to overcome an initial counter-power greater than is actually needed for the training, as the case is with devices used for training from a laid-down position or when performing sit-up exercises. In accordance to embodiments of the present invention, a device and method are disclose in which a device with a special mechanical pivoted system can accept the arms of the user, can provide a controllable counter-force and can lead the user's body to bent in the proper way, letting the spinal backbone bent properly and the abdominal muscles train properly while applying training force on the device. Yet, Yet, in accordance to other embodiments of the present invention, a device and method are disclose in which a system having a special spring, or a set of springs, can be held by, for example, the arms of the user, can provide a controllable counter-force and can lead the user's body to bent in the proper and healthy trajectory, letting the spinal backbone bent properly and the abdominal muscles train properly while applying training force on the device.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
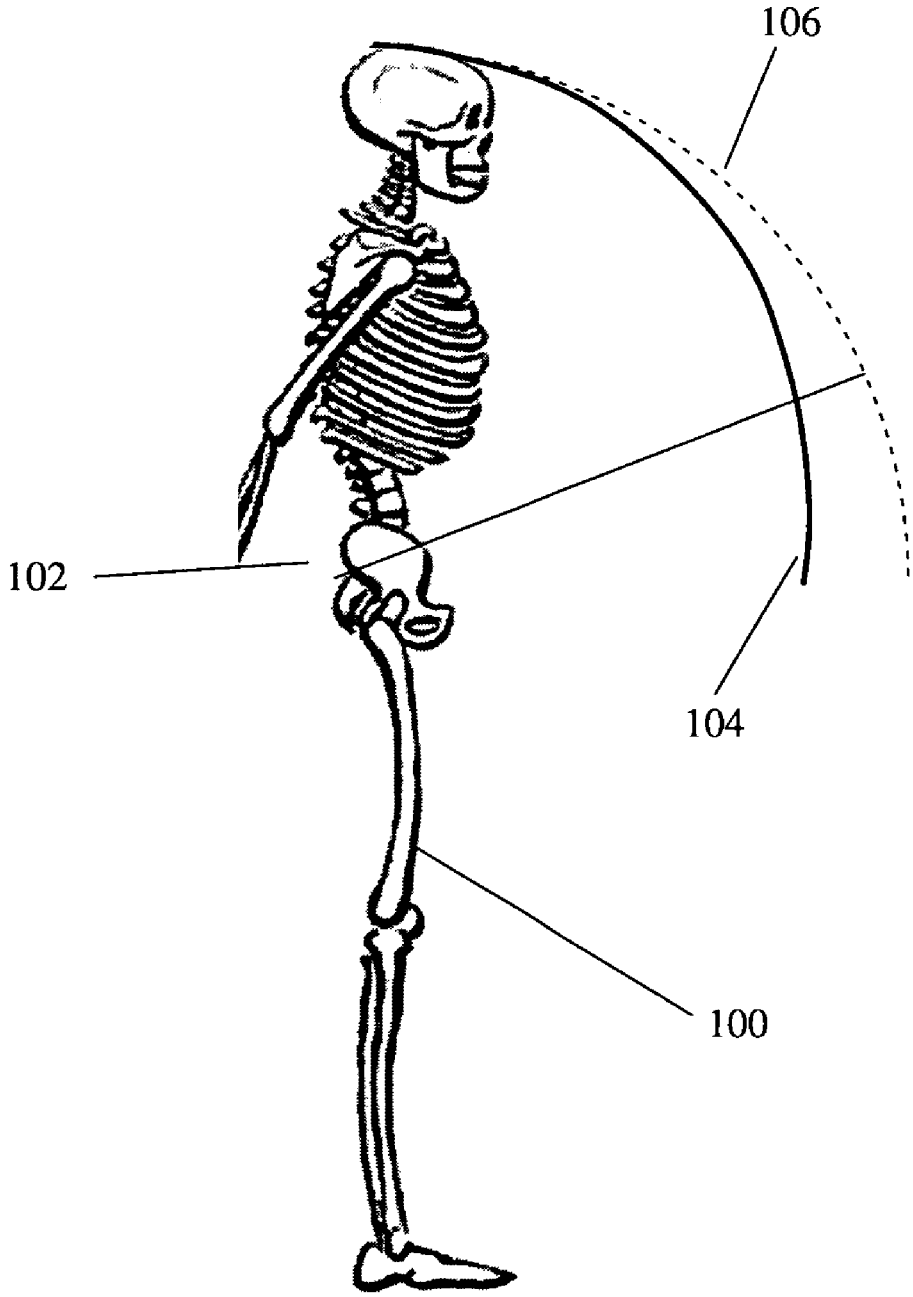
FIG. 1 is a schematic illustration of a desired trajectory performed when using a device for training abdominal muscles, in a straight up and in a bent position, respectively, according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Attention is made to FIG. 1 which is a schematic illustration of a desired trajectory to be performed when using a device for training abdominal muscles, in a straight up and in a bent position, respectively, according to embodiments of the invention. FIG. 1 depicts exemplary skeleton 100 which is used here to present the difference between a desired trajectory, or a curve of bending 104 of a human body 100, presented by a trajectory drawn by the top of the head of body 100. Trajectory 104 differs from, for example, a trajectory 106, which is substantially a sector of a circle, performed by the body when training abdominal muscles by a device having a pivotal point close to the pelvis 102, such as devices known in the art.

Figure 2:
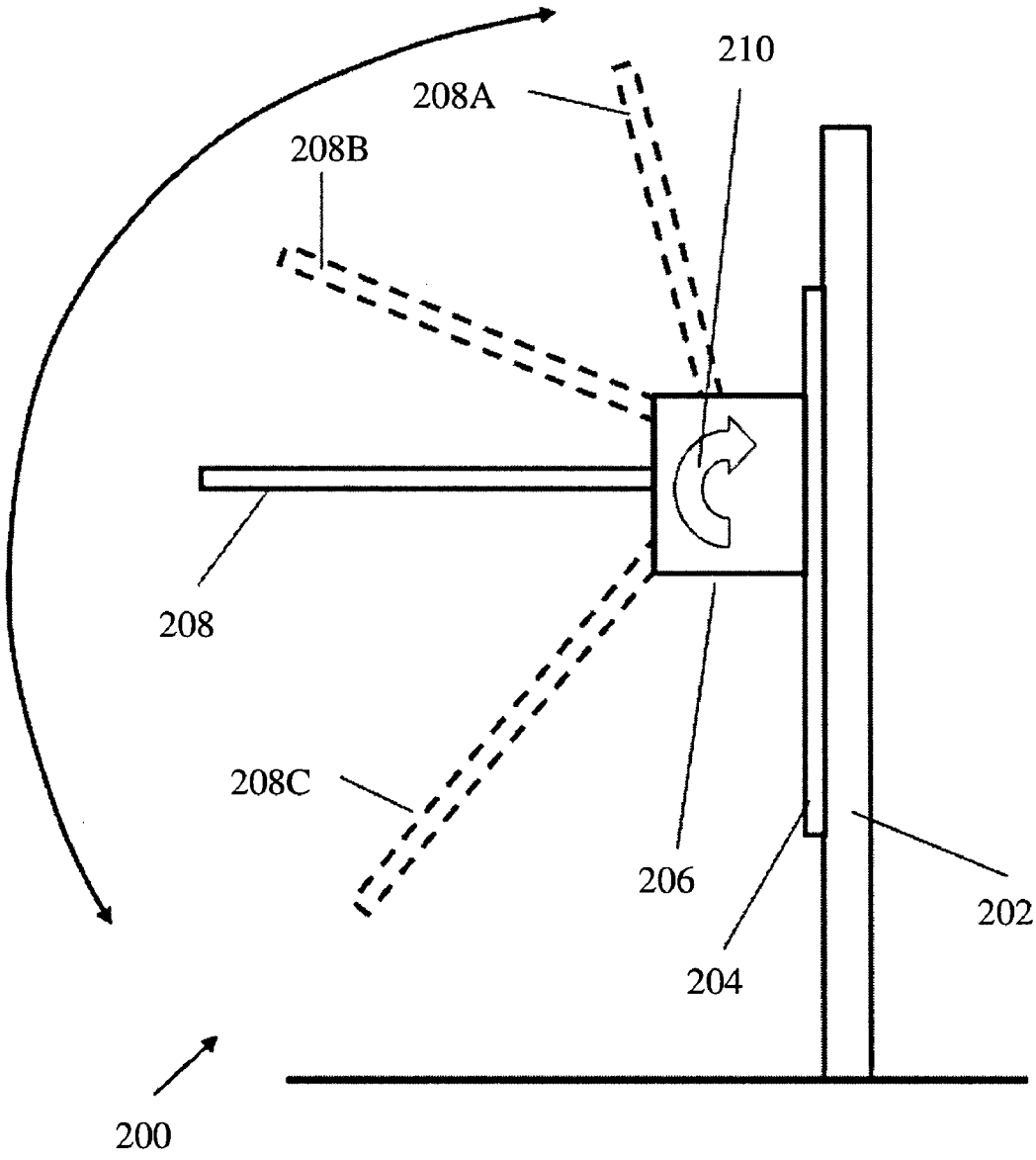
FIG. 2 is a schematic illustration of a training device according to embodiments of the present invention.

Attention is made to FIG. 2, which is a schematic illustration of a training device 200 according to embodiments of the present invention. Device 200 may comprise an installation coordinator unit 204, a mechanical pivoting assembly 206 and holding assembly 208. Device 200 may be installed on a substantially vertical support 202, such as a wall or a beam. Coordinator unit 204 may be a simple installation plate to connect assembly 206 and holding assembly 208 to the wall, according to some embodiments of the present invention. According to other embodiments of the present invention coordinator unit 204 may be built to allow setting of assembly 206 and holding assembly 208 at a desired height above the floor, to fit the user's personal measurements. Assembly 206 may be connected onto coordinator unit 204, for example, by vertical sliding rails equipped with preset locking positions and a locking mechanism (not shown), or free-running rails with locking mechanism allowing locking assembly 206 onto coordinator unit 204 at any desired point in the dynamic range of motion. Assembly 206 may comprise a specially designed pivoted mechanism which leads 208 from, for example, their most upper position (substantially vertical position) to a lower position, in such a path that forces the lower portion of the spinal backbone to bent properly, causing the bent point in the spinal backbone to move gradually from the lower backbone part to upper portions of the backbone as the bending angle increases. Holding assembly 208 may provide easy to use design. The movement of holding assembly 208, when training force is applied for example by the user's hands to distal end point 209 of holding assembly 208, is symbolized by dashed lines images of holding assembly 208A, 208B, 208C and 208D, while solid line 208 symbolizes a momentary position of holding assembly 208 at a given point in time. Device 200 may further comprise a counter-force unit 210 (schematically symbolized by a single head arc arrow). Counter-force unit 210 may be based on a simple spring which has to extend when holding assembly 208 is forced down, or on a pneumatic/hydraulic actuator (such as a piston) modified to provide a desired profile of forces in the dynamic range of the operation of holding assembly 208 as a function of the applied force by the user, the rate of change of the speed of movement, the user's weight etc. . . . . It would be apparent to one skilled in the art that the examples given above for embodiments of counter-force unit 210 are not limiting and many other configurations of controllable counter-force unit may fit.

It should be emphasized that assembly 206 may be realized in many ways yet, it is built, in all of its different embodiments, to ensure that when a user lays his arms on holding assembly 208 and pushes them down against counter-force unit 210, the movement of holding assembly 208 with respect to coordinator unit 204, against which the user's back leans, causes the spinal backbone to gradually bend in the desired manner along a curved path, ensuring correct workout of the abdominal muscles.

Figures 3A, 3B:
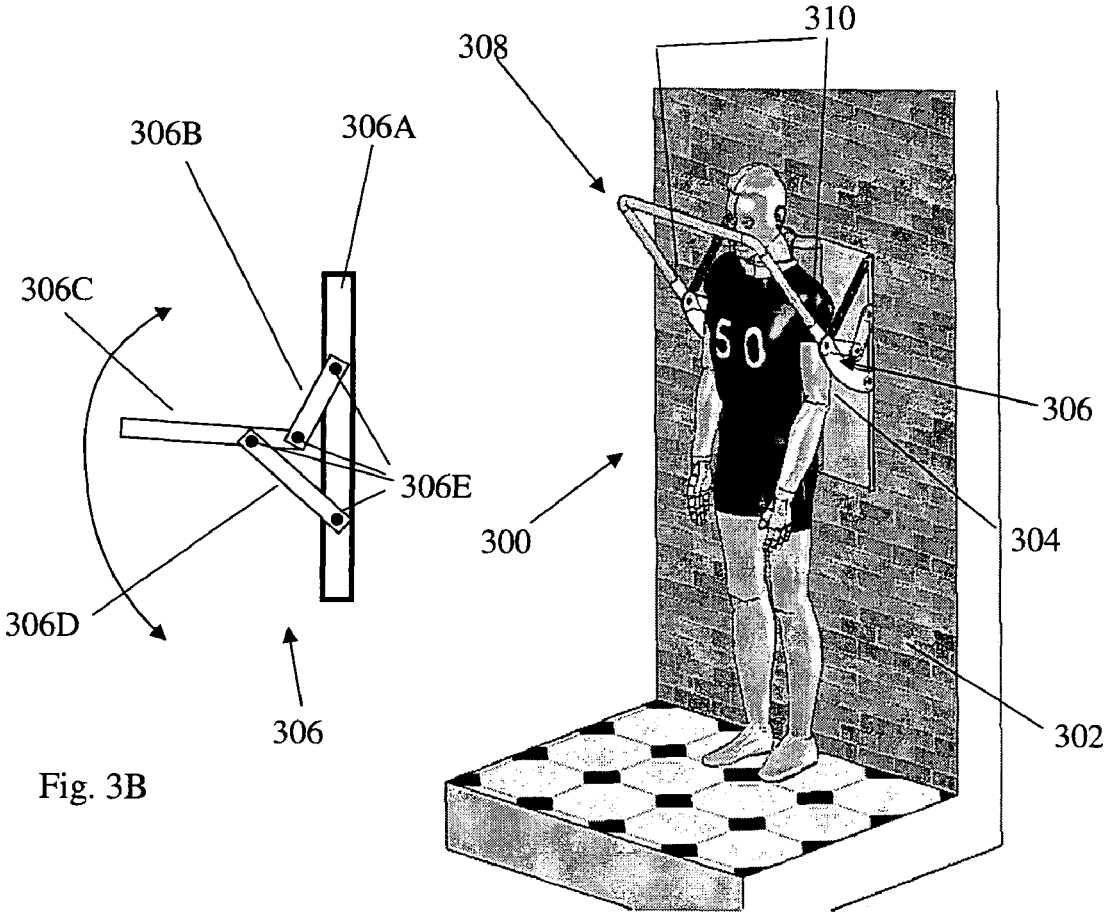
FIGS. 3A, 3C and 3D are schematic illustrations of a training device according to embodiments of the present invention, shown in an angle of 30°, 60° and 90° of holding assembly, respectively.
FIG. 3B is a schematic detailed illustration of pivoted assembly according to embodiments of the present invention.
Figure 3C:
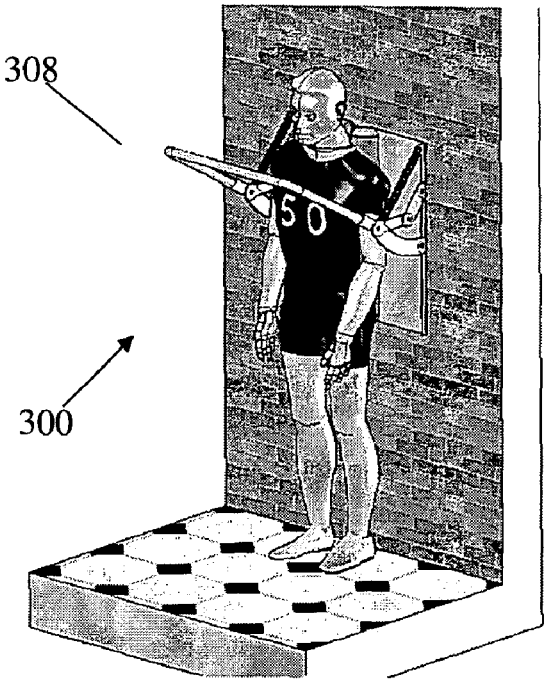
Figure 3D:
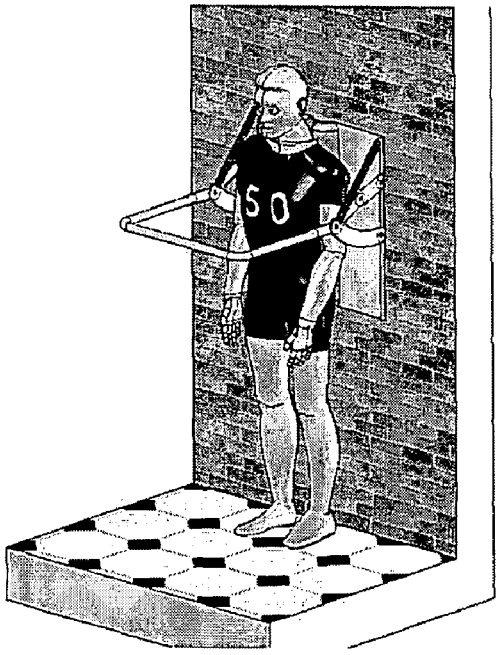

Attention is made now to FIGS. 3A, 3C and 3D which are schematic illustrations of training device 300 according to embodiments of the present invention, in an angle of inclination 30°, 60° and 90° of holding assembly 308, respectively, and to FIG. 3B which is a schematic detailed illustration of pivoted assembly 306 according to embodiments of the present invention. Device 300 may comprise a coordinator plate 304, a pivotal assembly 306, device holding assembly 308 and counter-force unit 310. Referring now to FIG. 3B, assembly 306 may comprise, according to embodiments of the present invention, a back portion 306A pivotally connected to short joint part 306B and long joint part 306D at their first ends, each. Both short joint part 306B and long joint part 306D are also connected, at their second ends to holding assembly connection joint 306C as shown in the drawing. As may be clearly seen from FIG. 3B, the movement of joint part 306C up and down involves also smooth movement of joint part 306C towards back portion 306A, when it points up and away from back portion 306A when joint part 306C points horizontally (as it is drawn in FIG. 3B) and then, as joint part 306C turns to point down it moves back towards back portion 306A. FIGS. 3C and 3D present device 300 when holding assembly 308 are in 60° and 90°, respectively.

Figure 4:
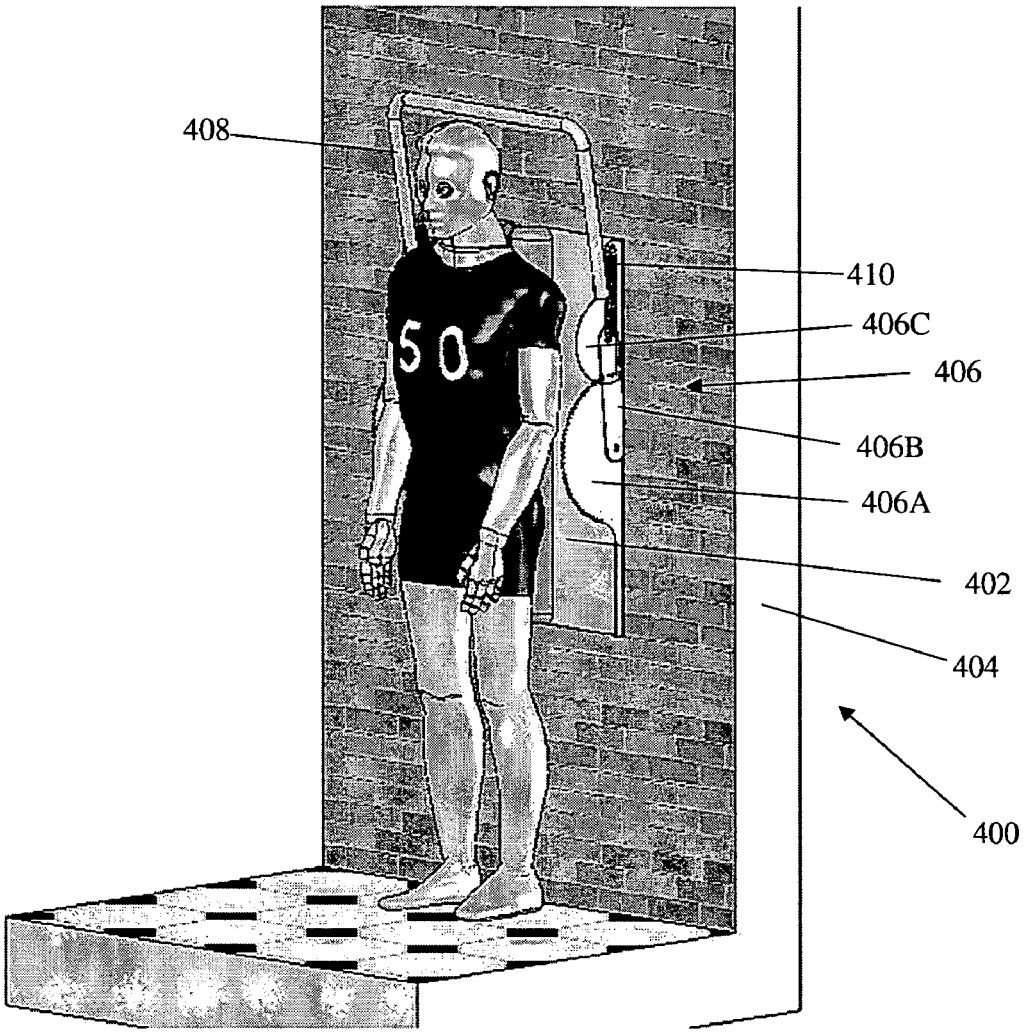
FIG. 4 is a schematic illustration of a training device for the abdominal muscles, according to embodiments of the present invention.

Attention is made now to FIG. 4 which is a schematic illustration of a training device 400 for the abdominal muscles with holding assembly according to embodiments of the present invention. Device 400 may comprise a back coordinator plate 402 to enable installation on a support wall or beam 404, a pivotal assembly 406 installed on coordinator plate 402 and holding assembly 408 connected to pivotal assembly 406 to provide pivoted movement up and down. Device 400 may further comprise counter-force unit 410 to provide counter-force to the user. According to embodiments of the present invention assembly 406 may comprise a first cogged section 406A attached to coordinator plate 402 and a second cogged section 406C adapted to engageably roll on first cogged section 406A. First cogged section 406A and second cogged section 406C may be moveably secured to each other by linking rod 406B. Holding assembly 408 may be fixedly attached to second cogged section 406C and move and turn with it, as it rolls on first cogged section 406A.

It will be noted that the specific path of movement of holding assembly of FIG. 2, FIGS. 3A-3D and FIG. 4 may be personally adapted to fit to the user's physical dimensions or the user's physiological needs. For example, the actual dimensions of joint parts 306B and 306D and the distances between the involved pivoted connections 306E may be changed to control the actual path of movement of holding assembly 308, as may be needed for a specific user. Similarly, the radiuses of cogged sections 406A and 406C of FIG. 4 may be changed to control the actual path of movement of holding assembly 408 to fit the needs of a specific user.

It will also be noted that the force applied by counter-force unit 310, 410 may be adjustable to enable meeting the training needs of the user. Additionally, the nature of the force applied by counter-force unit 310, 410 may also be controlled to provide one of several profiles of force versus amount for the movement of the arms, versus the speed of movement of the arms, etc.

Figure 5:
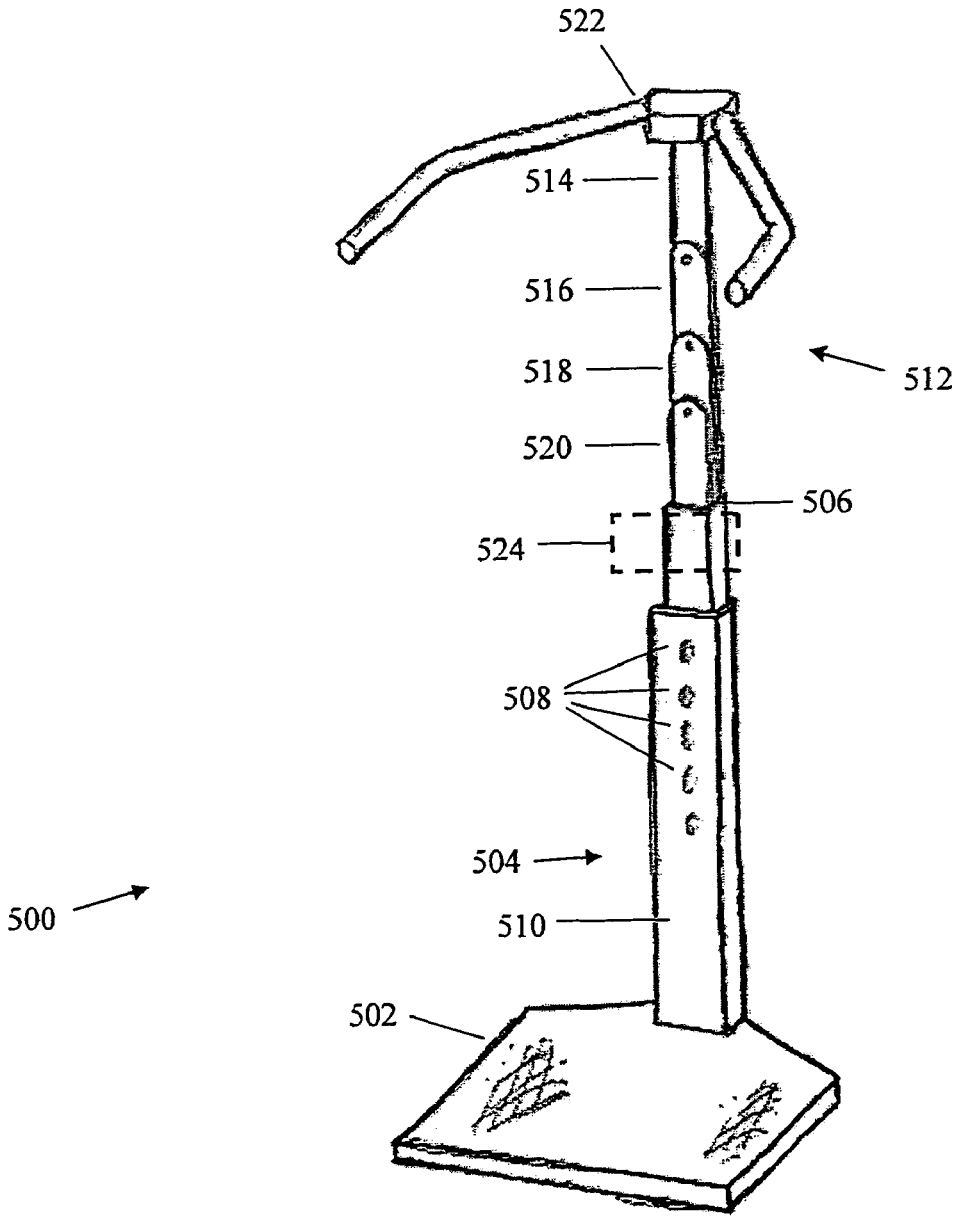
FIG. 5 is a schematic illustration of a training device according to additional embodiment of the present invention.

Attention is made now to FIG. 5, which is a schematic illustration of a training device 500 according to additional embodiments of the present invention;

Device 500 may comprise a base 502 to which a supporting hollow column 504 is attached, substantially vertically. An insert 506 may be made to closely fit into the internal dimensions of column 504 and allow easy movement of insert 506 inside column 504. Column 504 may have one or more holes 508 at least at one of its facets 510 and preferably also at the corresponding opposite facet (not shown). One or more holes with internal diameter same as holes 508 may be made in insert 506, to allow fixing of insert 506 inside column 504 in one of several locations, to adjust the amount at which insert 506 extends out of column 504. However, other methods and arrangements for allowing adjustment of the amount at which insert 506 extends out of column 504 may be used, such as using a piston, for example hydraulic or pneumatic, and the like. It would be apparent for a person skilled in the art that any known device and method may be used for adjusting the extension of insert 506 out of column 504 and the fixation of insert 506 to column 504.

A set 512 of leaf springs 514, 516, 518, 520 . . . may be attached to the upper end of insert 506 so that the springs form a cascaded arrangement where second leaf spring 516 is attached next to a first leaf spring 514 and only partially overlapping it, so that a certain length of leaf spring 514 is not attached to leaf spring 516. Similarly a third leaf spring 518 is attached next to said second leaf spring 516 and only partially overlapping it, etc. Set of etc. Set of springs 512 may comprise one or more leaf springs. Leaf springs 514, 516 . . . may be arranged so that the amount of overlapping of leaf spring 516 over leaf spring 514 and the amount of overlapping of leaf spring 518 over leaf spring 516, etc., may be adjustable. A holding assembly 522 may be connected substantially at the end of springs set 512, allowing holding and applying of bending force by a user when held by the user's hands. The extension adjustment of insert 506 within column 504 allows the adjustment of the total height of device 500 to fit the specific height of the user.

When a user stands on base 502 with his/her back abuts column 504 and he/she holds holding assembly 522, after it was adjusted to fit his/her height, pulling of holding assembly forwards and downwards may invoke a bending force on springs set 512 so that first the leaf spring with lesser counter-force, that is spring 514, bends. When force applied by the user grows bigger at a certain point leaf spring 516 begins bending, adding its counter-force to the total counter force of springs set 512. Similarly springs 518, 520 and so on may join the active group of leaf springs and provide their respective counter force. Thus, the applying of bending force by a user to holding assembly 522 may invoke a counter force that is a function of the performed path, along trajectory 518, which has already been made so that the counter force grows bigger due to the nature if operation of each single spring and due the changing number of springs activated at each point of the trajectory. This leads the user to perform a correct bending movement of the spinal backbone and therefore correct activation and training of the abdominal muscles. In order to adjust the training force and the specific trajectory to the user, the overlapping of each leaf spring over its adjacent leaf spring may be separately and uniquely adjusted. Alternatively or additionally the unique spring force function may also be controlled by dictating the thickness of the spring and/or the material it is made of.

According to embodiments of the present invention device 500 may comprise a rear support 524 for providing a rear lower support to be used when training. The support may be made of any suitable material, size and shape. Rear support 524 may be attached fixedly onto insert 506, or may be moveable to provide further freedom in adapting device 500 for a specific user.

Figure 6:
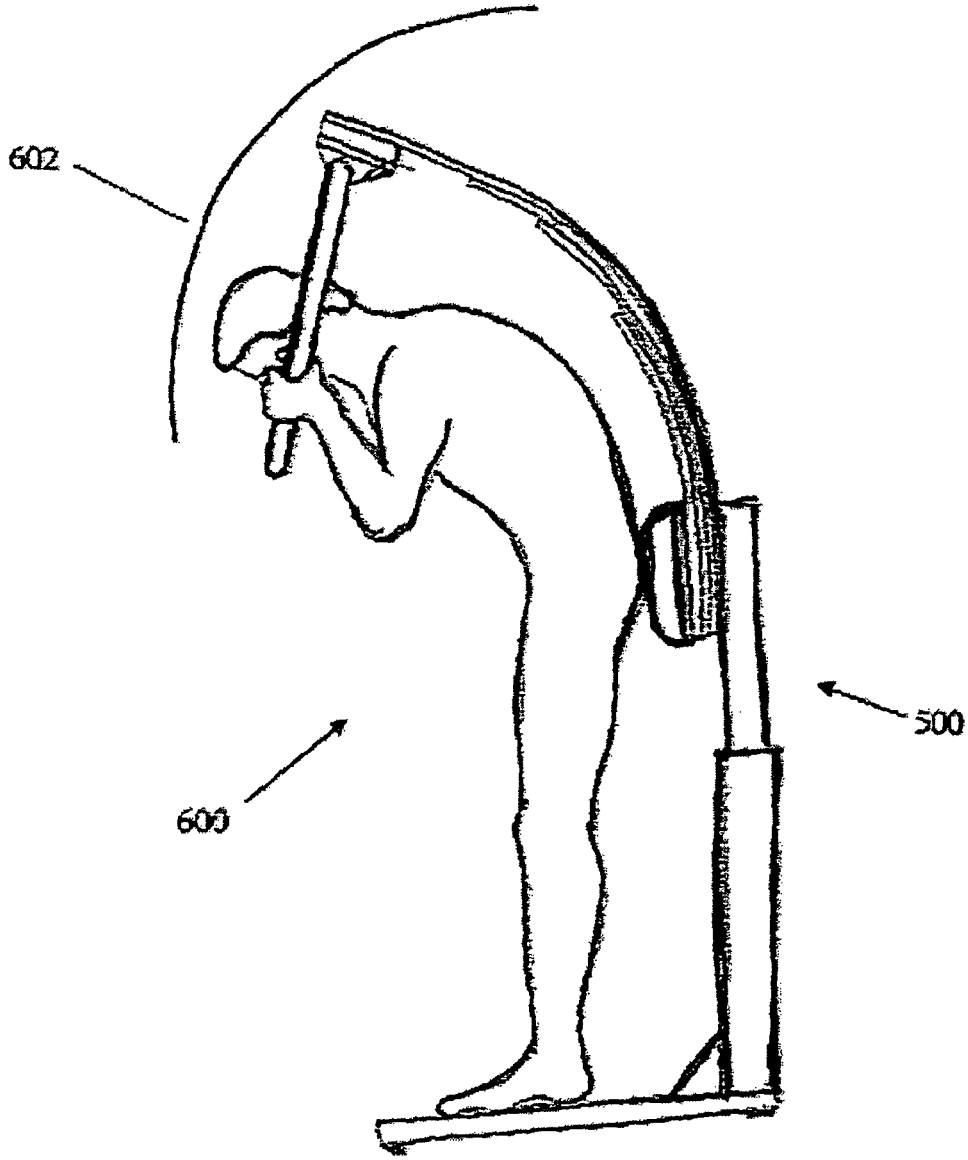
FIG. 6 is a schematic illustration of a desired trajectory performed when using the device illustrated in FIG. 5 for training abdominal muscles, in a straight up and in a bent position, respectively, according to embodiments of the present invention.

Attention is made now to FIG. 6 which is a schematic illustration of a desired trajectory performed when using the training device 500 (FIG. 5) for training abdominal muscles, in a straight up and in a bent position, respectively, according to embodiments of the present invention.

FIG. 6 depicts a user's body 600, using device 500 (which is presented in details hereinabove) when in a bent position, the user's body performing a correct curve, or trajectory, 602.

Figure 7:
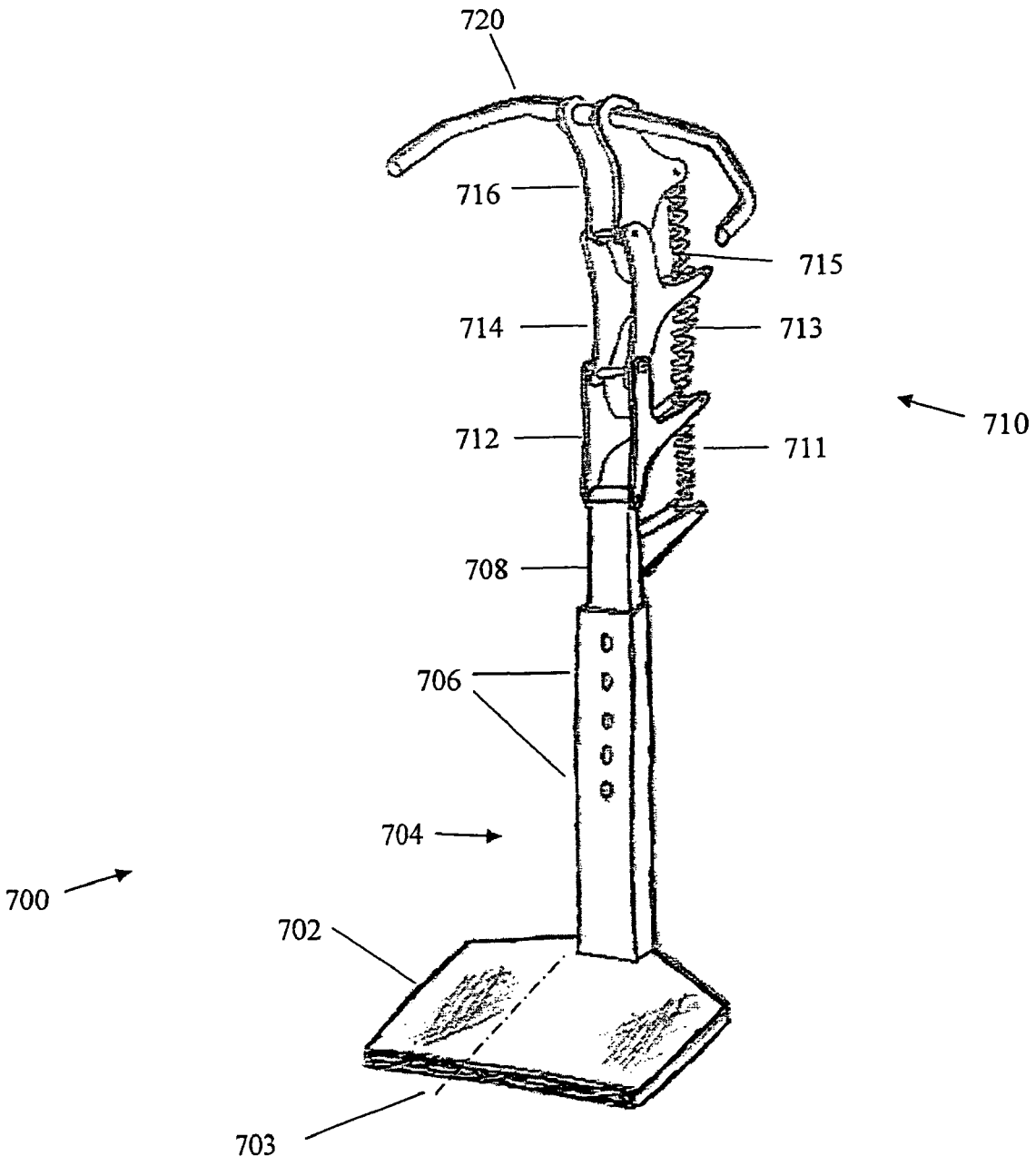
FIG. 7 is a schematic illustration of a training device according to yet additional embodiment of the present invention.

Attention is made now to FIG. 7, which is a schematic illustration of a training device 700 according to additional embodiments of the present invention. Training device 700 may comprise a base 702, a column 704 attached to base 702 substantially vertically, an insert 708, functioning similarly to insert 506 of FIG. 5 and allowing adjustment of the amount of its insertion into, or out of column 704 similarly to the way it is described with respect to column 504 and insert 506 of FIG. 5. Device 700 may further comprise a set of joints 710, comprising two or more joints 712, 714, 716 . . . attached to the upper end of insert 708. Joints 712, 714, 716 may be pivotally connected to each other and their pivots may be substantially parallel to each other, arranged in a totem pole type of arrangement extending substantially upright when no force is applied by the user to the holding assembly 720 of the device. The pivotal connection is made to allow free pivoted movement in an imaginary plane comprising in it column 704 and crossing base 702 substantially in the middle, along dashed line 703. Joints 712, 714, 716, etc. may be connected to insert 708 and one to its adjacent joint also with springs 711, 713, 715 respectively in a spinal backbone like structure, wherein the pivots of joints 712, 714, 716 correlate to the cartilage off the human backbone and springs 711, 713, 715 correlate to the muscles and tendons of a spinal backbone. The topmost joint, in the example of FIG. 7 joint 716, may also comprise or be attached to a holding assembly 720, allowing holding device 700 by user's hands and applying of bending force by the user. When a user applies bending force to holding assembly 720 pulling force is applied, acting to extend springs 711, 713, 715, etc, each at its time. The length of each of joints 712, 714, 716, and the spring force coefficient of each of springs 711, 713, 715 etc. may be selected to fit to the needs of a specific user, so as to enforce the user to perform the right bending trajectory when using device 700 and to allow the user to select the right bending force. The specific parameters of springs 711, 713, 715 etc. may be selected to cause, for example, spring 715 to extend first when force applied to holding assembly 720, and only after a certain force has been applied to begin extending of spring 713, etc. thus controlling the specific trajectory performed by the user of device 700.

According to embodiments of the present invention device 700 may comprise a rear support (not shown) for providing a rear lower support to be used when training. The support may be made of any suitable material, size and shape. The rear support may be attached fixedly onto insert 708, or may be moveable to provide further freedom in adapting device 700 for a specific user.

Figure 8:
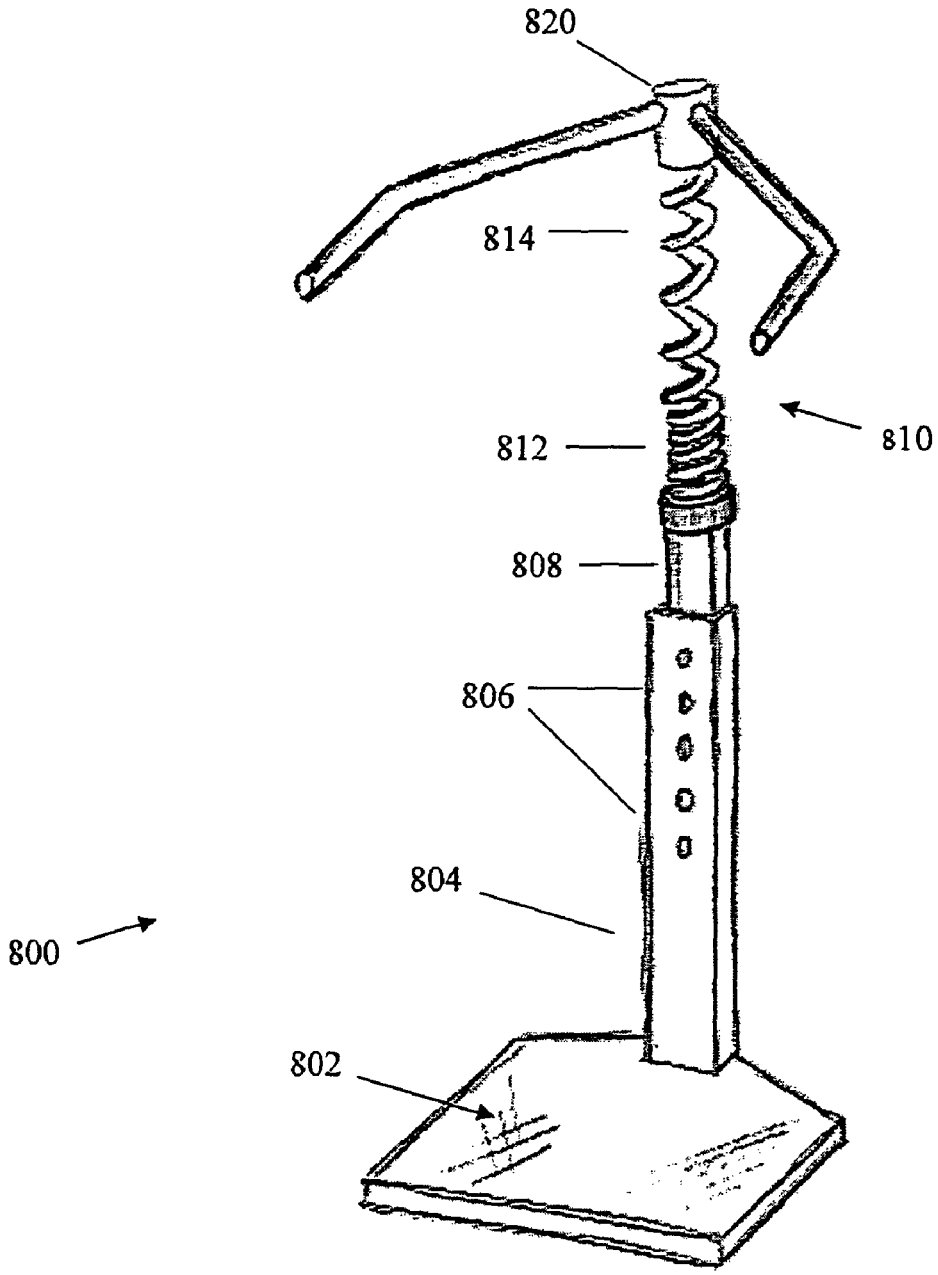
FIG. 8 is a schematic illustration of a training device according to yet additional embodiments of the present invention.

Attention is made now to FIG. 8, which is a schematic illustration of a training device 800 according to yet additional embodiments of the present invention. Training device 800 may comprise a base 802, a column 804 attached to base 802 substantially vertically, an insert 808, functioning similarly to insert 506 or 708 of FIGS. 5 and 7 respectively, and allowing adjustment of the amount of its insertion into, or out of column 804 similarly to the way it is described with respect to column 504, 704 and insert 506, 708 of FIGS. 5 and 7, respectively. Device 800 may further comprise a spring 810 attached to the upper end of insert 808, which may have zones along its longitudinal dimension, such as zones 812 and 814, each having a different spring factor or coefficient, thus providing different response to a bending force. A holding assembly 820 may be connected substantially at the upper end of spring 810, allowing holding and applying of bending force by a user when held by the user's hands. When in use the user may stand on base 802, adjust the amount of insertion of insert 808 into, or out of column 804, to fit the height of holding assembly 820 to the needs of the user. When the user applies a bending force via holding assembly 820 spring 810 may bend according to the specific bending factor vs. force at each zone, for example zones 812, 814 of spring 810. For example, spring 810 may be designed so that the first section that will bend when a growing bending force is applied to holding assembly 810 will be the upper section, and after it will bend a section adjacent lower of the first section, etc. A proper design of spring 810 will provide the required bending counter force to the user and will cause spring 810 to bend so that the user's body will follow the desired and correct bending trajectory, allowing the abdominal muscles to properly be worked and be trained.

According to embodiments of the present invention device 800 may comprise a rear support (not shown) for providing a rear lower support to be used when training. The rear support may be made of any suitable material, size and shape. The rear support may be attached fixedly onto insert 808, or may be moveable to provide further freedom in adapting device 800 for a specific user.

Figure 9:
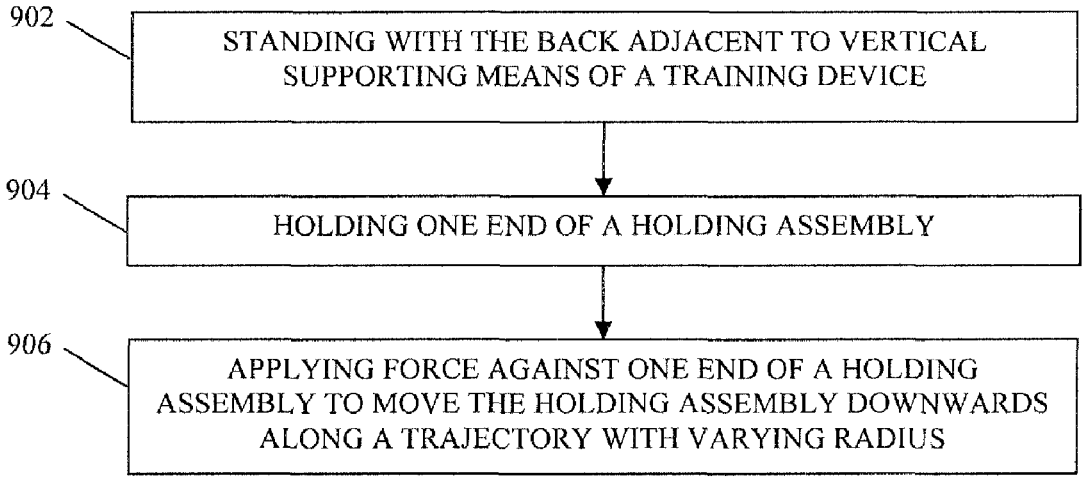
FIG. 9 illustrates a flow diagram of a method for using a training device in accordance to embodiments of the present invention.

Attention is made now to FIG. 9 which illustrates a flow diagram of a method for using a training device in accordance to embodiments of the present invention. The method may comprise standing with the back of the user adjacent to vertical supporting means of a training device (block 902), holding of holding assembly (block 904), and applying bending force against one end of a holding assembly to move the holding assembly downwards along a trajectory with varying radius (block 906).

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A device comprising:

a holding assembly operable by a user, said user to operate said holding assembly at one end;

counter-force unit comprising two or more zones having each different spring coefficient;

substantially vertical supporting means to support said holding assembly and said counter-force unit; and an insert, insertable into a column and attachable to said column at a desired amount of insertion wherein said counter-force unit is adapted to provide adjustable counter-force to downwards movement of said holding assembly;

wherein the movement of said one end of said holding assembly downwards in response to an applied force by said user is along a curve path having a radius that changes as said holding assembly moves;

wherein the movement of said one end of said holding assembly downwards activates said zones in an orderly manner, a first zone first, wherein said counter-force unit comprises a set of leaf springs attached at the top of said insert, said set of leaf springs comprising at least two leaf springs attached to one another side-by-side so that one spring only partially overlaps its adjacent leaf spring, wherein the amount of partial overlapping of at least one said leaf spring over its adjacent leaf spring is adjustable, and wherein said holding assembly is attached at the upper end of said leaf spring set to allow applying of bending force to said leaf spring set.

2. The device of claim 1, wherein said substantially vertical supporting means comprises a back coordinator plate adjustably connected to said vertical supporting means to adjust the height of said holding assembly.

3. The device of claim 2 wherein said holding assembly further comprising a pivoted assembly connected at a first side to said coordinator portion plate, said pivoted assembly is to lead said holding assembly from its most upper position to a lower position along said curve path.

4. The device of claim 3 wherein said counter-force unit connected to said pivoted assembly or to said holding assembly to provide adjustable counter-force to downwards movement of said holding assembly.

5. The device of claim 1, wherein said leaf springs to be selected so that a topmost leaf spring with lesser counter-force to be bent first when force is applied to said holding assembly, and said additional leaf springs are to begin bending when the applied force gradually grows bigger.

6. The device of claim 1, wherein said supporting means comprises said supporting column and a base, said supporting column substantially vertical to said base.

7. The device of claim 1 wherein each of said insert and said column comprises a plurality of holes so that said insert to be fixable inside said column in one of a plurality of height locations to adjust the extension of said insert in or out of said column.

8. The device of claim 1 further comprises a rear support to be attached fixedly onto said insert or to be moveable to adapt said device for a specific user.

9. The device of claim 1 further comprising:

an insert, insertable into a column and attachable to said column at a desired amount of insertion; and a set of joints, said set of joints comprising at least two joints pivotally connected to each other at one side, and further connected to each other with a spring at a second side, wherein the lowest joint of said set of joints to be attached to the upper end of said insert, and the topmost joint of said set of joints to be connected to said holding assembly.

10. The device of claim 9, wherein said springs to be selected so that a topmost spring is with lesser counter-force, and the other springs are to extend when the applied force gradually grows bigger.

11. The device of claim 9, wherein said supporting means comprises said supporting column and a base, said supporting column substantially vertical to said base.

12. The device of claim 9 wherein each of said insert and said column comprises a plurality of holes so that said insert to be fixable inside said column in one of a plurality of height locations to adjust the extension of said insert in or out of said column.

13. The device of claim 9 further comprises a rear support to be attached fixedly onto said insert or to be moveable to adapt said device for a specific user.

* * * * *